US008695621B2

(12) United States Patent
Park

(10) Patent No.: US 8,695,621 B2
(45) Date of Patent: Apr. 15, 2014

(54) GAS SAFETY DEVICE

(75) Inventor: Sung-Hyung Park, Seoul (KR)

(73) Assignee: En Innovation Co., Ltd. (KR)

( * ) Notice: Subject to any disclaimer, the term of this patent is extended or adjusted under 35 U.S.C. 154(b) by 0 days.

(21) Appl. No.: 13/702,157

(22) PCT Filed: May 13, 2011

(86) PCT No.: PCT/KR2011/003543

§ 371 (c)(1),
(2), (4) Date: Dec. 5, 2012

(87) PCT Pub. No.: WO2011/155709

PCT Pub. Date: Dec. 15, 2011

(65) Prior Publication Data

US 2013/0087215 A1 Apr. 11, 2013

(30) Foreign Application Priority Data

Jun. 10, 2010 (KR) ..... 10-2010-0054882

(51) Int. Cl.
*F23D 14/72* (2006.01)

(52) U.S. Cl.
USPC ..... 137/66; 137/80; 126/42; 431/77

(58) Field of Classification Search
USPC ..... 137/65, 66, 79, 80; 126/42; 431/77
See application file for complete search history.

(56) References Cited

U.S. PATENT DOCUMENTS

| | | | | |
|---|---|---|---|---|
| 6,364,656 | B1 * | 4/2002 | Chen | 431/46 |
| 2001/0042564 | A1 * | 11/2001 | Abraham et al. | 137/65 |
| 2003/0102025 | A1 * | 6/2003 | Garcha | 137/66 |
| 2008/0216897 | A1 * | 9/2008 | Wu | 137/66 |

FOREIGN PATENT DOCUMENTS

| | | | | |
|---|---|---|---|---|
| JP | 11037466 | 2/1999 | | |
| KR | 1998-067228 | * 10/1998 | | F24C 3/12 |
| KR | 200254426 | 11/2001 | | |
| KR | 1020070003736 | 1/2007 | | |

OTHER PUBLICATIONS

International Search Report—PCT/KR2011/003543 dated Feb. 6, 2012.
International Written Opinion—PCT/KR2011/003543 dated Feb. 6, 2012.

* cited by examiner

*Primary Examiner* — John K Fristoe, Jr.
*Assistant Examiner* — Reinaldo Sanchez-Medina
(74) *Attorney, Agent, or Firm* — Cantor Colburn LLP

(57) ABSTRACT

A gas safety device is provided. An electronic valve connected to a thermocouple is closed to cut off the gas supply when the temperature of radiant heat directly emitted from a surface of a vessel exceeds a preset temperature level while the vessel is heated through the spark ignition of a burner, thereby preventing risks of overheating and thus fire caused due to a user's carelessness when the user cooks the food.

2 Claims, 3 Drawing Sheets

GAS SAFETY DEVICE

TECHNICAL FIELD

The present invention relates to a gas safety device capable of automatically cutting off the gas supply in a cooking appliance (for example, a gas range, a gas oven range, a gas burner, etc.), and, more particularly, to a gas safety device capable of preventing the risk of fire caused by overheating while food is cooked in a cooking appliance.

BACKGROUND ART

In general, a combustion apparatus, which is applied in cooking appliances using liquefied natural gas (LNG) or liquefied petroleum gas (LPG) as a fuel, performs a heating operation as sparks are ignited by bringing a gas fuel in contact with air. The heating from the combustion apparatus results in food being cooked.

That is, the cooking appliance is made of a metal, and includes a cooking body composed of one or plural grills on which a cooking vessel is placed, and a combustion apparatus formed in the grills.

In this case, the combustion apparatus is composed of a burner, a spark plug, and a thermocouple having a heating point of contact. The sparks are ignited from the spark plug and a heating operation is then performed with gas combustion in the burner only when the heating point of contact of the thermocouple is increased to a predetermined temperature or higher. When the heating point of contact of the thermocouple is not increased to the predetermined temperature, the sparks are ignited from the spark plug, but the heating operation is not performed with gas combustion in the burner.

Meanwhile, a gas fuel supplied to the combustion apparatus of the cooking appliance is usually supplied through a transfer pipeline from the outside to the inside of a building when the cooking appliance such as a gas range or a gas oven range is installed to be fixed.

That is, a gas fuel is guided and supplied from a gas supplier's storage tank through a transfer pipe buried underground, or guided through a gas supply pipe from a gas tank installed at the rooftop or outside the building. In general, one end of a middle valve (or a safety valve) configured to control the flow of a gas is connected to one end of the gas supply pipe, one end of a hosepipe is connected to the other end of the middle valve, and the other end of the hosepipe is connected to the cooking appliance.

Therefore, a gas is supplied from the gas supply pipe to a combustion apparatus installed at the cooking appliance through the hosepipe when the middle valve is open. As a result, when a user ignites sparks (for example, press the button or handles a rotary-type switch), a gas sprayed from the combustion apparatus burns to perform a heating operation.

Meanwhile, the combustion apparatus installed at the cooking appliances always has a risk of accidents since the gas is used as a fuel. In the prior art, various safety devices have been disclosed to solve the problems regarding the use of a gas fuel.

In one example, when a user forgets that food is being cooked using a cooking appliance, a vessel carrying the food is over-heated, resulting in the vessel being blackened and the food being burned, or even in a conflagration.

Therefore, the safety devices configured to sense overheating of a combustion apparatus when the combustion apparatus is overheated and automatically cut off the supply of a gas fuel have been disclosed in the prior art.

In this case, in the conventional gas safety devices, an electronic valve is configured to be electrically connected to a thermocouple so as to determine the supply of a gas.

That is, the gas safety device acts to sense sparks from a burner, convert the sparks into an electrical signal (i.e., a thermoelectromotive force), transfer the converted electrical signal to an electronic valve, and open the electronic valve to supply a gas to the burner. In this case, when the converted electrical signal is not transferred to the electronic valve, the gas safety device acts to close the electronic valve and cut off the gas supply to the burner.

However, the gas safety device does not precisely detect a heating state of the vessel since the gas safety device senses the sparks of the burner and converts the sparks into an electrical signal.

That is, the conventional gas safety devices serve to determine the opening/closing of an electronic valve using an electrical signal of the sparks rather than directly sensing a heating temperature of a vessel and determining the opening/closing of an electronic valve. In this case, a maximum running temperature of a thermocouple is approximately 600° C., and a boiling point of the contents in the vessel disposed at the burner is approximately 100° C. As a result, the moisture content in the vessel is evaporated, the vessel is overheated.

However, the conventional gas safety devices are run to sense sparks until a running temperature of a thermocouple reaches the maximum temperature of approximately 600° C., convert the sparks into an electrical signal (i.e., a thermoelectromotive force) and cut off the gas supply. Therefore, the conventional gas safety devices often malfunctions because the gas supply through the electronic valve is not cut off when the running temperature of the thermocouple does not reach a temperature of approximately 600° C. even though the moisture content in the vessel is completely evaporated at a temperature of approximately 100 to 150° C. and a surface of the vessel is blackened.

DISCLOSURE

Technical Problem

Therefore, the present invention is designed to solve the problems of the prior art, and therefore it is an object of the present invention to provide a gas safety device capable of allowing an electronic valve connected to a thermocouple to be closed to cut off a gas supply when the temperature of radiant heat directly emitted from a surface of a vessel exceeds a preset temperature level while the vessel is heated through spark ignition of a burner, thereby preventing risks of overheating and thus fire caused due to a user's carelessness when the user cooks food.

Technical Solution

One aspect of the present invention provides a gas safety device including a spark plug, a burner, a thermocouple configured to generate a thermoelectromotive force as sparks are ignited in the burner, and an electronic valve unit to which the thermocouple is electrically connected via a plurality of connection lines and which is opened or closed to control gas supply to the burner according to the transfer of the thermoelectromotive force generated in the thermocouple. Here, safety switching units configured to determine whether the thermoelectromotive force generated in the thermocouple is transferred to the electronic valve unit in response to a change in temperature of radiant heat on a surface of a vessel, and simultaneously to control the gas supply are connected in series to one of the plurality of connection lines connecting the thermocouple with the electronic valve unit.

In this case, the safety switching unit may be a bimetal switch installed at one side of the burner and configured to switch off to cut off the transfer of the thermoelectromotive force to the electronic valve unit when the temperature of the radiant heat exceeds a preset temperature level and switch on to transfer the thermoelectromotive force to the electronic valve when the temperature of the radiant heat is less than the preset temperature level.

Also, the preset temperature may be in a range of 180 to 200° C.

Advantageous Effects

As described above, since the gas safety device according to the present invention is configured to close an electronic valve connected to a thermocouple to cut off a gas supply when the temperature of radiant heat directly emitted from a surface of a vessel exceeds a preset temperature level while the vessel is heated through spark ignition of a burner, risks of overheating and thus fire caused due to a user's carelessness when the user cooks food can be prevented.

DESCRIPTION OF DRAWINGS

These and other features, aspects, and advantages of preferred embodiments of the present invention will be more fully described in the following detailed description, taken accompanying drawings. In the drawings.

BEST MODE

Hereinafter, preferred embodiments of the present invention will be described in detail referring to the accompanying drawings.

Figure 1:
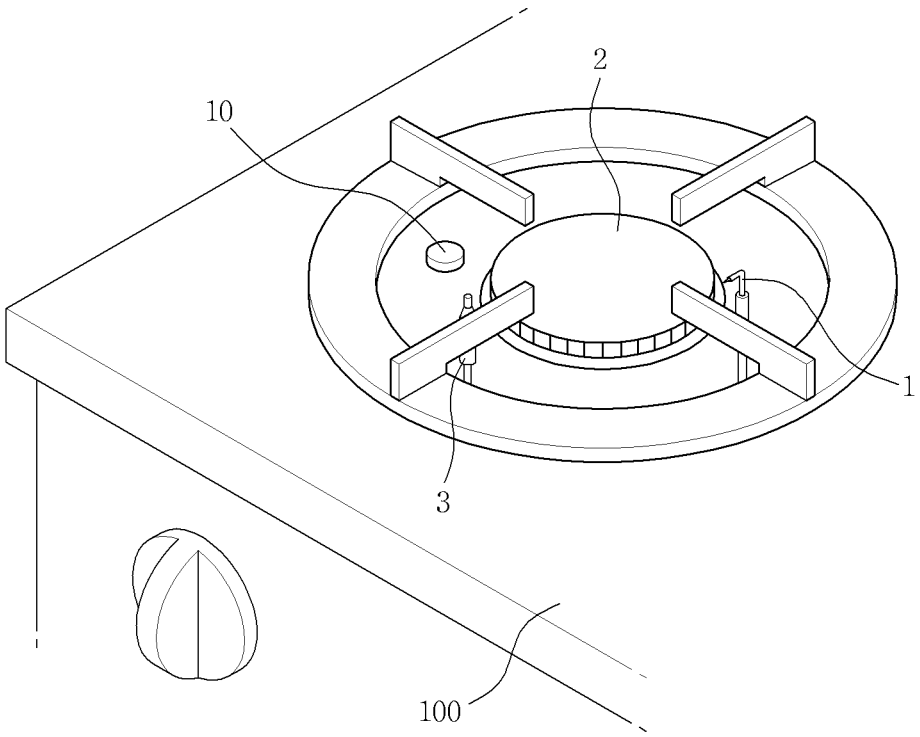
FIG. 1 is a schematic perspective view showing a configuration of a gas safety device according to one exemplary embodiment of the present invention.
Figure 2:
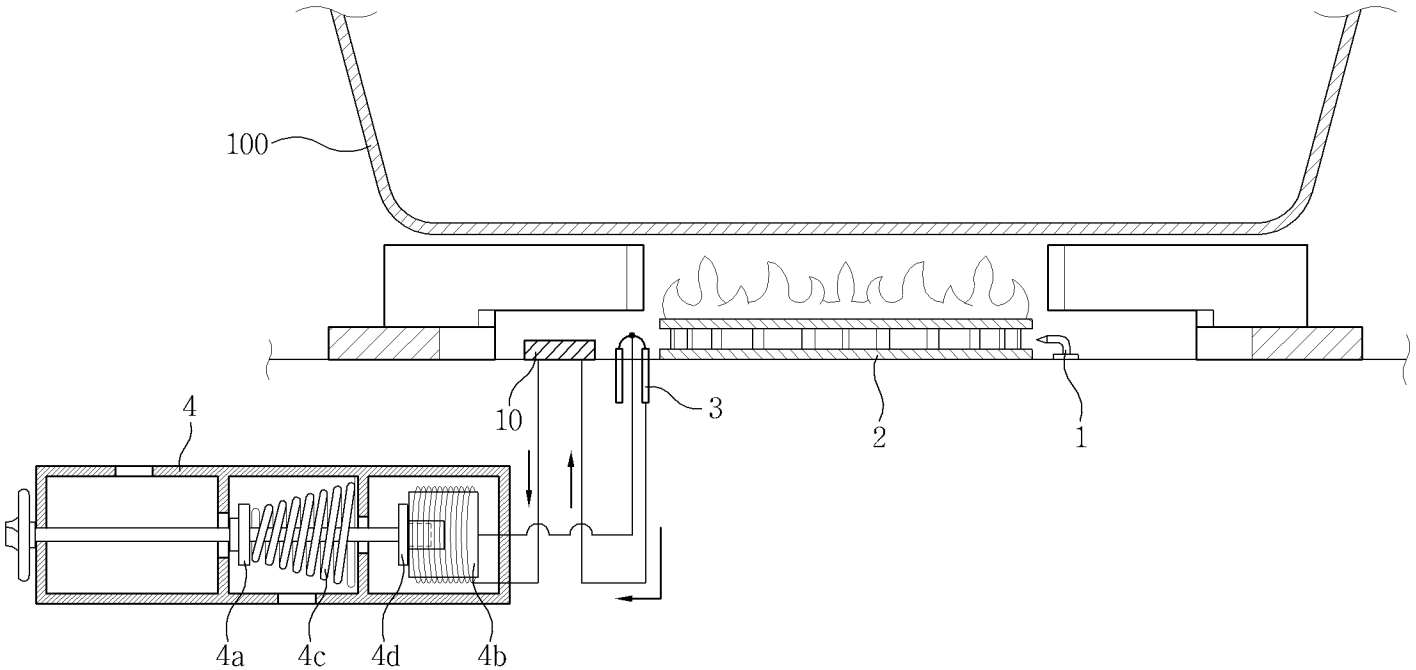
FIG. 2 is a schematic cross-sectional view showing that a gas is supplied when the safety switching unit is switched on according to one exemplary embodiment of the present invention.
Figure 3:
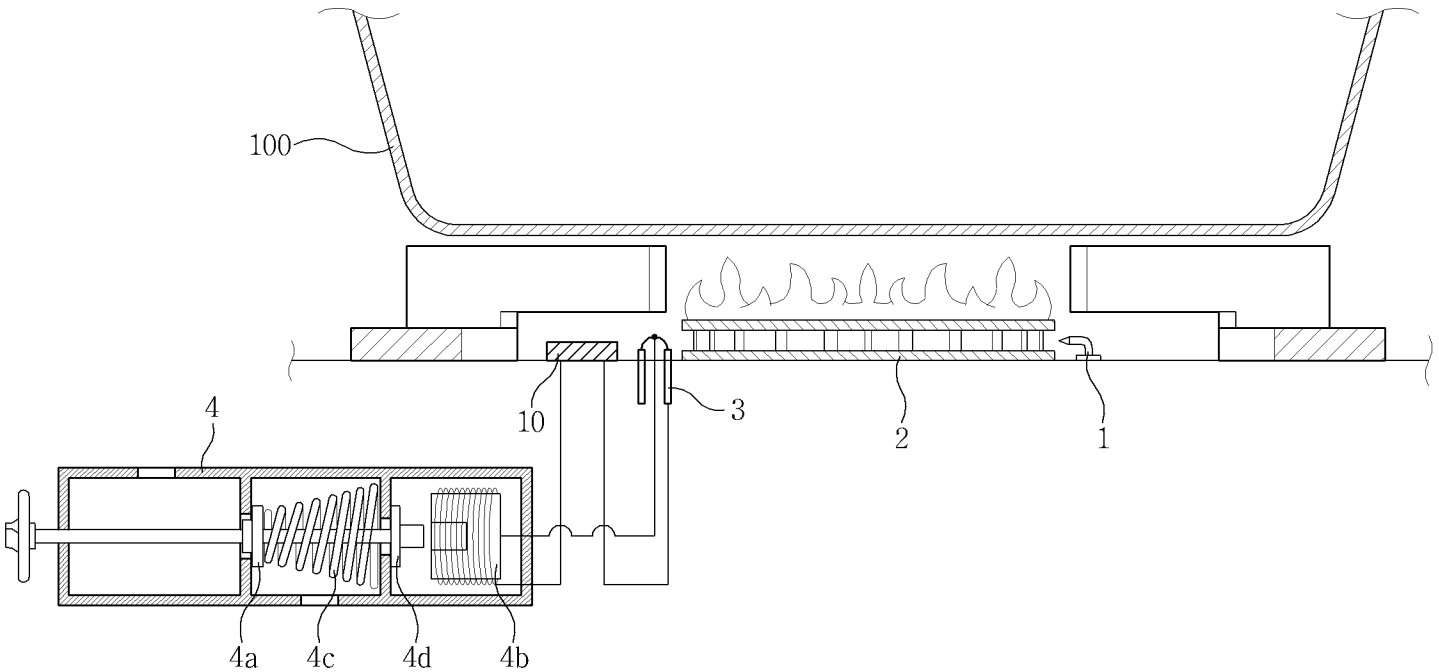
FIG. 3 is a schematic cross-sectional view showing that the gas supply is cut off as the safety switching unit is switched off according to one exemplary embodiment of the present invention.

FIG. 1 is a schematic perspective view showing a configuration of a gas safety device according to one exemplary embodiment of the present invention, FIG. 2 is a schematic cross-sectional view showing that a gas is supplied when the safety switching unit is switched on according to one exemplary embodiment of the present invention, and FIG. 3 is a schematic cross-sectional view showing that the gas supply is cut off as the safety switching unit is switched off according to one exemplary embodiment of the present invention.

Referring to FIGS. 1 to 3, the gas safety device according to one exemplary embodiment of the present invention includes a spark plug 1, a burner 2, a thermocouple 3 configured to generate a thermoelectromotive force as sparks are ignited in the burner 2, and an electronic valve unit 4 to which the thermocouple 3 is electrically connected via a plurality of lines L1 and L2 and configured to be opened and closed to control the gas supply to the burner 2 according to the transfer of the thermoelectromotive force generated in the thermocouple 3. Here, safety switching units 10 are configured to be connected in series with one line L2 of the plurality of lines L1 and L2.

That is, the safety switching unit 10 is a bimetal switch which is in a switched-off mode when the temperature of radiant heat is in a range of 180 to 200° C. and in a switched-on mode when the temperature of radiant heat is 180° C. or less. The safety switching unit 10 is configured to be installed at one side of the burner 2 to directly receive the radiant heat generated from the vessel 100 when the vessel 100 is heated by the burner 2.

Here, the electronic valve unit 4 has a conventional structure including a gas inlet. Thus, the electronic valve unit 4 includes a safety valve 4*a* connected to a gas supply line, an electromagnet 4*b*, a spring 4*c*, and a metal plate 4*d* connected to one line L1 of the plurality of lines L1 and L2 to perform a linear reciprocating motion.

That is, the electronic valve unit 4 is configured so that the thermocouple 3 generates a thermoelectromotive force of 20 to 750 mV from the spark ignition in the burner 2 and supplies the generated thermoelectromotive force to the electromagnet 4*b* via the line L2. In this case, the electromagnet 4*b* attracts the metal plate 4*d* connected with the safety valve 4*a* while generating a magnetic force, thereby supplying a gas to the burner 2 while opening the safety valve 4*a*.

Meanwhile, when the thermoelectromotive force is not generated in the thermocouple 3, the electronic valve unit 4 does not transfer the thermoelectromotive force to the electromagnet 4*b* via the line L2. Thus, a magnetic force is not generated in the electromagnet 4*b*, and the metal plate 4*d* attracted to the electromagnet 4*b* returns to an original position by means of a restoring force of the spring 4*c*, thereby cutting off the gas supply to the burner 2 while closing the safety valve 4*a*.

MODE FOR INVENTION

As described above, the gas safety device according to one exemplary embodiment of the present invention is configured to generate a thermoelectromotive force of approximately 20 to 750 mV in the thermocouple 3 formed at one side of the burner 2 when the vessel 100 is heated as the burner 2 is turned on through an igniting operation of the spark plug 1 in a state in which the vessel 100 containing the contents to be cooked is put on the burner 2, as shown in FIGS. 1 to 3.

In this case, the radiant heat is radially emitted when the vessel 100 is heated. Then, when the temperature of the emitted radiant heat does not exceed a preset temperature level of 160° C., the bimetal switch that is the safety switching unit 10 configured to be exposed to one side of the burner 2 is in a switched-on mode. Therefore, the generated thermoelectromotive force is transferred to the electromagnet 4*b* in the electronic valve unit 4 via the line L2 and the bimetal switch that is the safety switching unit 10.

As a result, the electromagnet 4*b* attracts the metal plate 4*d* connected to the safety valve 4*a*, as shown in FIG. 2.

Here, an elastic force of the spring 4*c* included in the electronic valve unit 4 to support the safety valve 4*a* is applied in a left direction, but the elastic force applied in a left direction is higher than a magnetic force generated in the electromagnet 4*b* due to the thermoelectromotive force generated in the thermocouple 3. Therefore, the magnetic force generated due to the thermoelectromotive force of the thermocouple 3 may not be higher than the elastic force of the spring 4*c*, which makes it difficult to attract the metal plate 4*d* spaced a certain distance therefrom.

Therefore, the safety valve 4*a* included in the electronic valve unit 4 upon initial ignition of the burner 2 may be opened by allowing a user to manually press an ignition knob (not shown).

That is, when the thermoelectromotive force generated in the thermocouple 3 is applied and transferred to keep the safety valve 4*a* opened by the manual operation of the ignition knob open, the electromagnet 4*b* may attract the metal plate 4*d* connected with the safety valve 4*a*.

Therefore, when the metal plate 4*d* is pulled by the electromagnet 4*b* in a right direction as shown in FIG. 2, the safety valve 4*a* connected to the metal plate 4*d* is also allowed to move to open a gas inlet of the electronic valve unit 4, thereby supplying a gas to the burner 2 through the opened gas inlet, as described above.

Meanwhile, the radiant heat is radially emitted when the vessel 100 is heated. Then, when the temperature of the emitted radiant heat exceeds a preset temperature level of 160° C. (for example, 160 to 200° C.), the moisture of the food in the vessel 100 is completely dried. As a result, the bimetal switch that is the safety switching unit 10 configured to be exposed to one side of the burner 2 is in a switching-off mode while the bimetal switch directly receives the radiant heat.

As a result, the bimetal switch connected in series with the bimetal switch is disconnected, and thus the thermoelectromotive force generated from the spark ignition of the burner 2 is not transferred to the electromagnet 4*b* included in the electronic valve unit 4 via the line L2, and the electromagnet 4*b* loses its magnetic force. Thus, the metal plate 4*d* attracted by the electromagnet 4*b* returns to an original position by means of a restoring force of the spring 4*c*.

In this case, the electromagnet connected to the metal plate 4*d* also returns to an original position to cut off the gas inlet formed in the electronic valve unit 4. In this case, the gas supply to the burner 2 via the electronic valve unit 4 is suspended, thereby stopping the heating of the vessel 100, which emits the radiant heat whose temperature exceeds a preset temperature level, while removing the ignition of the burner 2. As a result, it is possible to prevent the risk of fire caused due to overheating in which the moisture of the food in the vessel 100 is completely evaporated.

The preferred exemplary embodiments of the present invention have been described in detail. However, it should be understood that the detailed description and specific examples, while indicating preferred embodiments of the invention, are given by way of illustration only, since various changes and modifications within the scope of the invention will become apparent to those skilled in the art from this detailed description.

[Industrial Applicability]

The present invention relates to a gas safety device capable of preventing a risk of fire caused by overheating while food is cooked in a cooking appliance. Thus, the gas safety device can be applied in cooking appliances such as a gas range, a gas oven range, a gas burner, etc.

The invention claimed is:

1. A gas safety device comprising:

a spark plug;

a burner disposed on a region of a surface;

a thermocouple configured to generate a thermoelectromotive force as sparks are ignited in the burner;

an electronic valve unit to which the thermocouple is electrically connected via a plurality of connection lines and which is opened or closed to control gas supply to the burner according to the transfer of the thermoelectromotive force generated in the thermocouple, and a bimetal switch connected to one of the plurality of connection lines in series, and disposed on another region of the surface different from the region of the surface on which the burner is disposed, wherein the bimetal switch is configured to respond to a change in temperature of radiant heat on a surface of a vessel, switch off to cut off the transfer of the thermoelectromotive force to the electronic valve unit when the temperature of the radiant heat exceeds a preset temperature level, and switch on to transfer the thermoelectromotive force to the electronic valve when the temperature of the radiant heat is less than the preset temperature level.

2. The gas safety device according to claim 1, wherein the preset temperature is in a range of 180 to 200° C.

* * * * *